US009421802B2

(12) United States Patent
Melia et al.

(10) Patent No.: US 9,421,802 B2
(45) Date of Patent: Aug. 23, 2016

(54) REFERENCE STRIP

(75) Inventors: Francesc Melia, Palma de Mallorca Illes Balears (ES); Lluis Hierro, Sant Llorenç d'Hortons (ES); Xavier Garolera, Riells del Fai Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 1563 days.

(21) Appl. No.: 12/788,047

(22) Filed: May 26, 2010

(65) Prior Publication Data

US 2011/0292110 A1 Dec. 1, 2011

(51) Int. Cl.
*B41J 29/38* (2006.01)

(52) U.S. Cl.
CPC ..... *B41J 29/38* (2013.01)

(58) Field of Classification Search
None
See application file for complete search history.

(56) References Cited

U.S. PATENT DOCUMENTS

| | | | | |
|---|---|---|---|---|
| 5,742,303 | A | 4/1998 | Taylor et al. | |
| 5,774,141 | A | 6/1998 | Cooper et al. | |
| 6,264,303 | B1 * | 7/2001 | Watanabe | 347/37 |
| 6,302,514 | B1 * | 10/2001 | Eade et al. | 347/33 |
| 7,419,258 | B2 * | 9/2008 | Murakami et al. | 347/108 |
| 7,631,965 | B2 | 12/2009 | Samoto et al. | |
| 2004/0061044 | A1 | 4/2004 | Soar | |
| 2007/0086820 | A1 | 4/2007 | Goss et al. | |
| 2009/0251507 | A1 | 10/2009 | Lai et al. | |

* cited by examiner

*Primary Examiner* — Uyen Chau N Le
*Assistant Examiner* — Chad Smith
(74) *Attorney, Agent, or Firm* — HP Inc—Patent Department

(57) ABSTRACT

Provided is a system that includes a reference strip and a print head carriage. The reference strip includes transmission windows for transmitting signals. The transmission windows include bridges.

17 Claims, 5 Drawing Sheets

REFERENCE STRIP

BACKGROUND OF THE INVENTION

Print systems are oftentimes provided with scanning print heads. During a print operation, these print heads are moved ("scanned") along a scan axis for firing ink onto the substrate in a number of swaths, to the end of printing an image onto the substrate. During a printing operation, after each one or multiple scanning movements along the scan axis, the substrate is moved with respect to the print head and subsequently a next swath of ink is printed onto the substrate.

The print head is mounted onto a print head carriage. The print head carriage is usually mounted onto a guide for guiding the print head along the scan axis. The print head may be mounted on the carriage so as to be exchanged, or the print head and the print head carriage may form an integral assembly. Furthermore, it is advantageous to detect the position and/or the speed of the print head carriage. For an accurate detection of the print head carriage speed and/or position, most print systems are provided with a print head carriage feedback system.

BRIEF DESCRIPTION OF THE DRAWINGS

For the purpose of illustration, certain embodiments of the present invention will now be described with reference to the accompanying diagrammatic drawings, in which.

DETAILED DESCRIPTION

In the following detailed description, reference is made to the accompanying drawings. The embodiments in the description and drawings should be considered illustrative and are not to be considered as limiting to the specific embodiment of element described. Multiple embodiments may be derived from the following description and/or drawings through modification, combination or variation of certain elements. Furthermore, it may be understood that also embodiments or elements that are not literally disclosed may be derived from the description and drawings by a person skilled in the art.

It may be a challenge to detect the position of the print head in an environment where ink aerosol is dispersed during use, and wherein multiple parts may be replaced. It may be a challenge to provide a feedback system that is robust enough to allow operators to exchange, maintain and/or clean parts such as the print head with a relatively low risk of damaging the feedback system. At the same time the feedback system may be accurate to prevent possible misalignment of ink drops.

Figure 1:
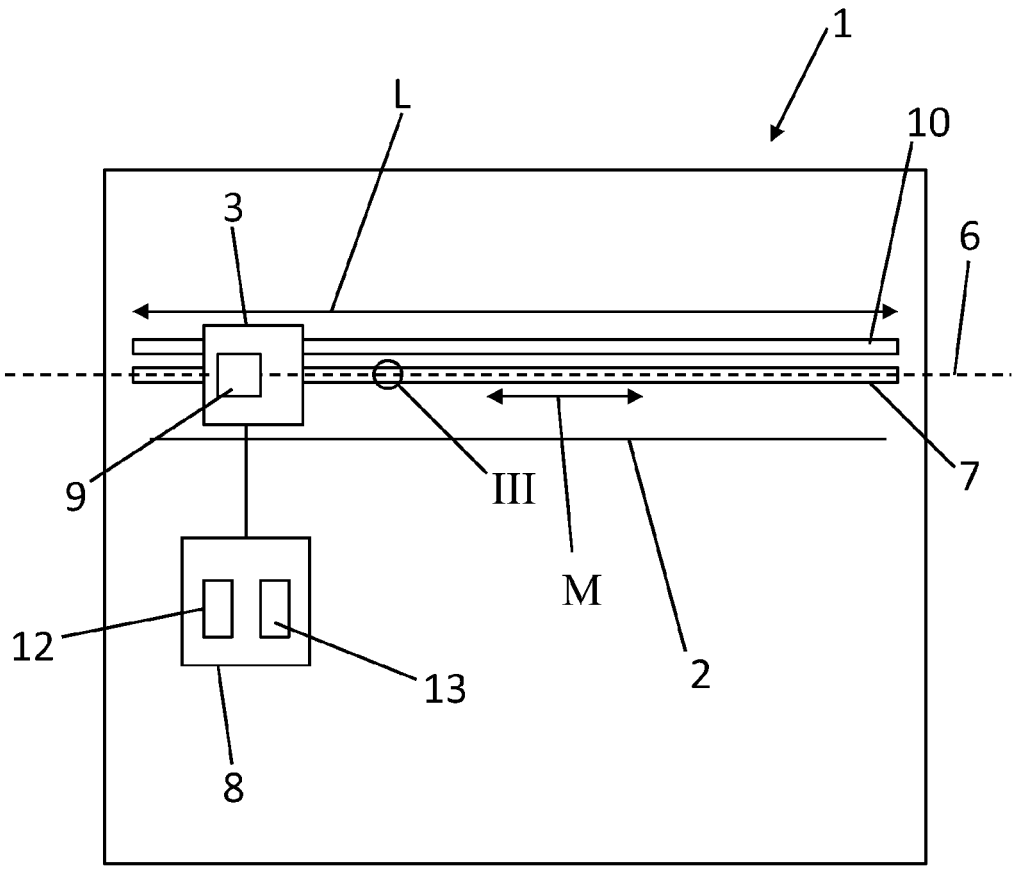
FIG. 1 shows a diagrammatic cross sectional front view of an embodiment of a print system with a print head carriage feedback system.

In FIG. 1 a diagrammatic overview of a print system 1 is shown. The print system 1 may comprise a large format printer, for example for printing substrates 2 having a height or width of at least approximately 0.5 meter, for example at least approximately 1 meter. In certain embodiments, the print system 1 may be arranged to print maximum substrate sizes according to industry standards such as 42 inch (1.07 meter) or 60 inch (1.52 meter), or another large format standard. The print system 1 may comprise a inkjet printer, for example a thermal inkjet or a piezo inkjet printer. Accordingly, the print head 5 may comprise an inkjet print head, for example a thermal inkjet or a piezo inkjet print head.

Figure 2:
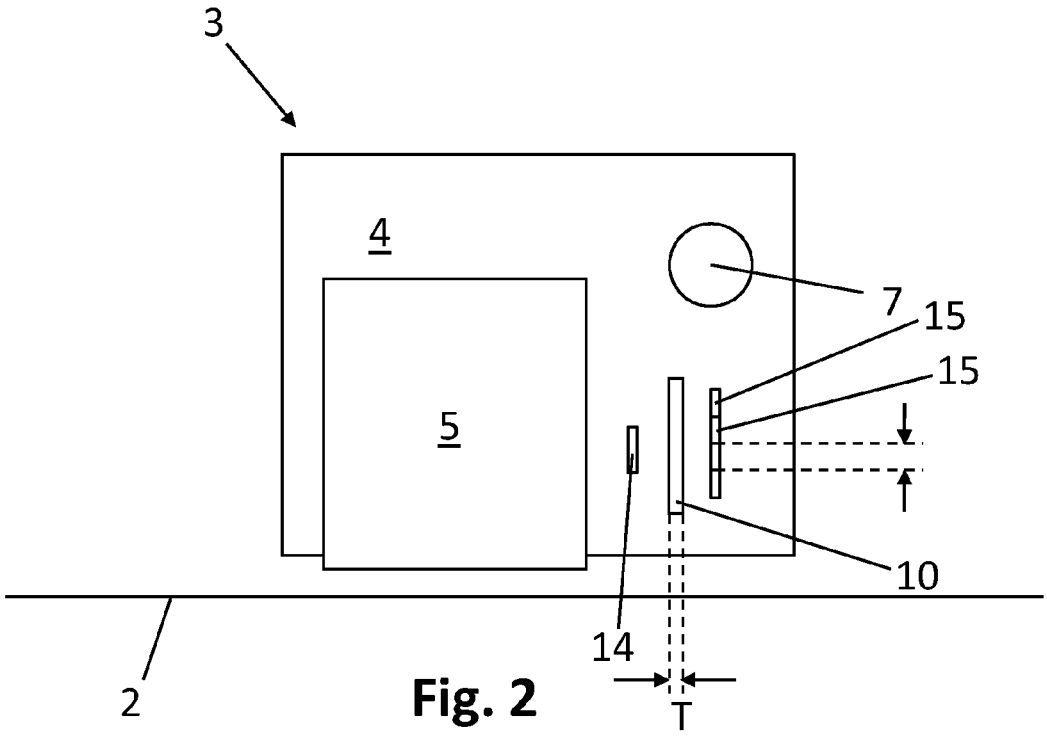
FIG. 2 shows a diagrammatic cross sectional side view of an embodiment of a print head carriage with a print head and a print head carriage feedback system.

The print system 1 may comprise a print head carriage 3. The print head carriage 3 may comprise a print head 5, as shown in FIG. 2. The print head 5 may be positioned in the print head carriage 3 so as to be removed. In such embodiment, the print head carriage 3 may comprise a print head holder 4. In another embodiment, the print head 5 may be integrally fixed within the print head carriage 3.

The print head carriage 3 may be arranged to scan along a scan axis 6 in opposite scanning directions M. The print head carriage 3 may be mounted onto a guide 7 to scan along the scan axis 6. The guide 7 may comprise a rail or tube or the like. A drive system (not shown) may be provided to drive the print head carriage 3 along the guide 7. The print head 5 may fire ink drops onto the substrate 2 while scanning in either one or both scanning directions M.

Figure 3:
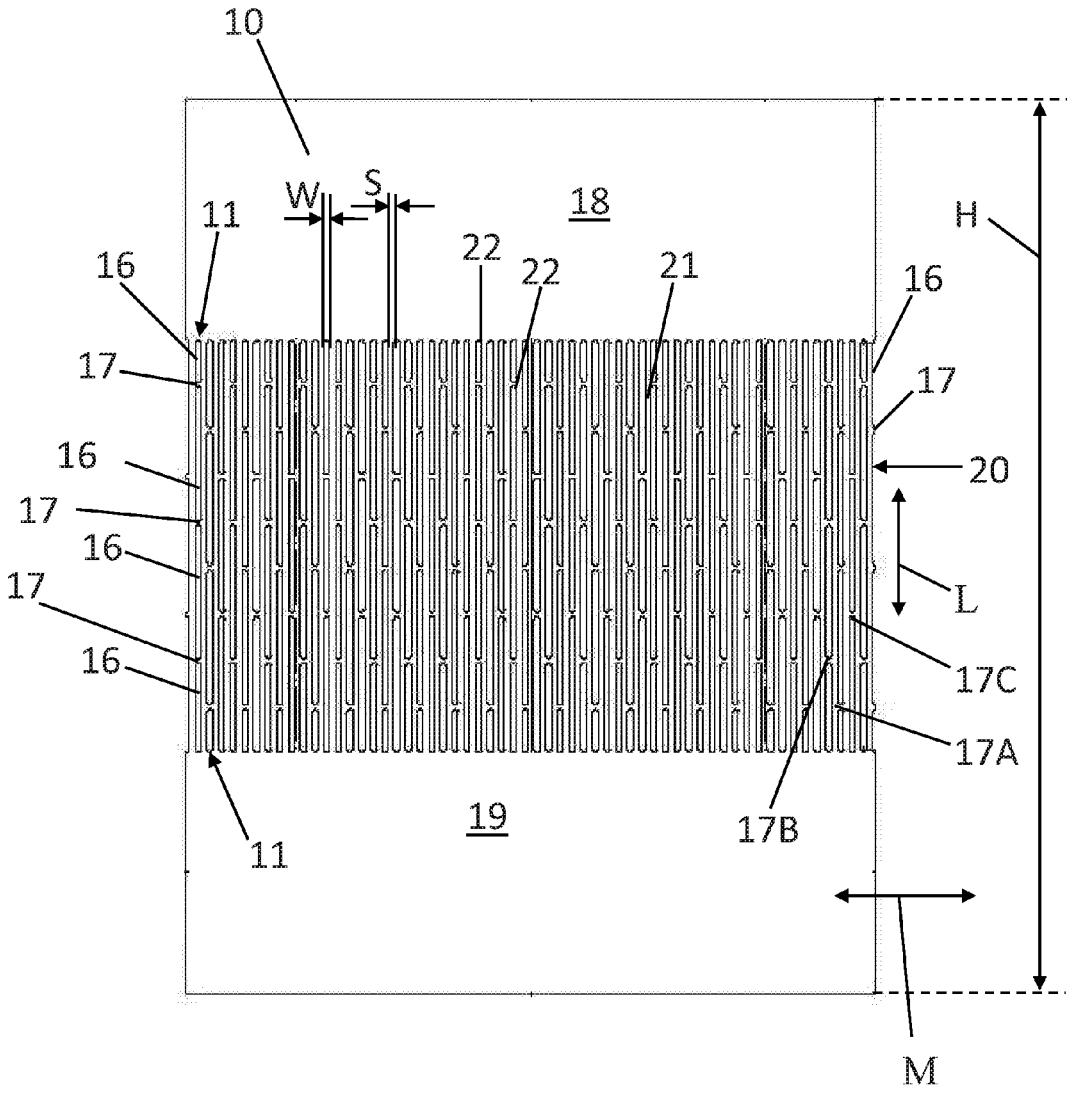
FIG. 3 shows a detail of a fragment of an embodiment of a reference strip.

The print system 1 may comprise a print head carriage feedback system for determining a position of the print head carriage 3 and providing feedback to a controller 8 about the position of the print head carriage 3. The print head carriage feedback system may comprise a detector 9 for determining a position of the print head carriage 3 with respect to the scan axis. The detector 9 may send signals to the controller 8 for further processing. In the shown embodiment, the detector 9 is mounted onto the print head carriage 3. The print head carriage feedback system may further comprise a reference strip 10 that is arranged along the scan axis. The reference strip 10 may extend parallel to the guide 7. The detector 9 may be arranged to use the reference strip 10 as a reference for detecting the position of the print head carriage 3 with respect to the scan axis 6. As shown in FIG. 2, the reference strip 10 may extend through the carriage 3. As shown in the embodiment of FIG. 3, the reference strip 10 may comprise transmission windows 11.

The print head carriage feedback system may further comprise a controller 8. The controller 8 may comprise a processor 13 that is configured to process signals received from the detector 9 for determining the position of the print head carriage 3 with respect to the scan axis 7, according to a predetermined algorithm. The controller 8 may further comprise a storage unit 12 comprising said algorithm for determining the position of the print head carriage 3 with respect to the scan axis 7.

The detector 9 may comprise an emitter 14 and a receiver 15, as illustrated by FIG. 2. In the shown embodiment, the detector 9 comprises multiple receivers 15 for detecting a signal from the emitter 14. The detector 9 may comprise an optical detector. The emitter 14 may comprise a LED (light emitting diode), a laser, or other light emitting source. The receiver 15 may be arranged to receive the signal that is emitted by the emitter 14, and transmitted by the transmission windows 11. The receiver 15 may comprise a diode or transistor type light receiver, for example a photodiode, a LED, or laser diode. In the shown embodiment, the emitter 14 comprises a LED and the receiver 15 comprises multiple photodiodes. The emitter 14 and receiver 15 may both be mounted on the print head carriage 3. The emitter 14 and the receiver 15 may extend on opposite sides of the reference strip 10. The receiver 15 may have a diameter E of approximately 1 millimeter or less, for example approximately 0.275 millimeter or less. Herein, the diameter E may be understood as the largest straight cross sectional distance between two opposite sides of the circumference of the receiver 15, and the receiver 15 may comprise a photodiode.

In other embodiments, the detector 9 may be arranged differently. For example, the emitter 14 may be mounted onto the print head carriage 3 and multiple receivers 15 may be mounted in the print system 1 so as to have a fixed position with respect to the reference strip 10 so that the print head carriage 3 moves with respect to the receivers 15. In again another embodiment, the detector may be fixedly arranged within the print system 1 while the receivers may be mounted onto the print head carriage 3.

FIG. 3 is a detailed front view of a portion of an embodiment of the reference strip 10. The reference strip 10 may comprise a multiple transmission windows 11. The transmission windows 11 may comprise windows for transmission of the light of the emitter 14. The transmission windows 11 may comprise cut outs extending through the reference strip 10. The emitter signal may pass between the emitter 14 and the receiver 15 without passing through a transparent layer. The signal may pass through air.

The transmission windows 11 may be arranged along a substantial part of the length L of the reference strip 10 in parallel to each other and also next to each other. The transmission windows 11 may have a substantially longitudinal shape, the longitudinal direction L being perpendicular to the scanning direction M. Each transmission window 11 may comprise one or more bridges 17. Such bridges 17 may locally reinforce the reference strip 10. The bridge 17 may extend across the width W of the respective transmission window 11. In this description, reinforcing may be understood as stiffening, strengthening, and/or locally decreasing the flexibility of the strip 10.

Each transmission window 11 may correspond to a position with respect to the scanning axis 7. Each transmission window 11 may comprise multiple transmission window portions 16. Transmission window portions 16 that correspond to the same transmission window 11 may be arranged on the same longitudinal axis A, having the same one dimensional position along the scanning axis 7, with a bridge 17 in between.

Figure 4:
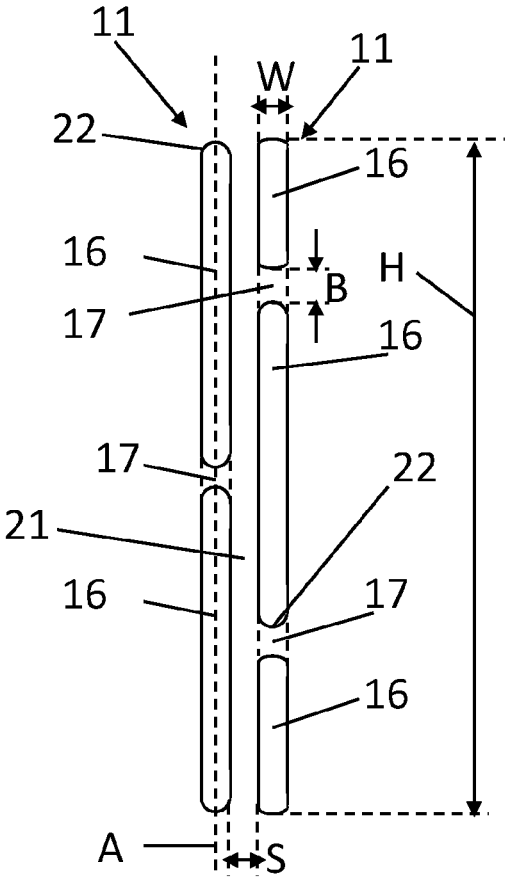
FIG. 4 shows and embodiment of two neighboring transmission windows in front view.

The transmission windows 11 may have rounded edges 22 near the ends, as is more clearly illustrated in FIG. 4. Accordingly, the bridges 17 may have rounded sides. The shape of the round edges 22 may depend on the manufacturing method of the transmission window portions 16. For example the transmission window portions 16 may be etched. In a further embodiment, the rounded edges 22 may have a reinforcing effect.

FIG. 4 shows an embodiment of two neighboring transmission windows 11 in a more detailed view. Each transmission window 11 may comprise one or more bridges 17, for example one, two, three, four, five or more bridges 17.

As can be seen from the embodiment of FIG. 3, the bridges 17 corresponding to certain transmission windows 11 may extend at a different location with respect to the bridges 17 of the neighboring transmission window 11. For example, as can be seen in FIG. 3, a first lowermost bridge 17A of a first transmission window 11 may extend at a different distance from a respective edge zone 18, 19 as compared to a neighboring lowermost bridge 17B, 17C of a second neighboring transmission window 11.

The reference strip 10 may comprise two edge zones 18, 19 and a transmission zone 20. The reference strip 10 may comprise a top edge zone 18 and a bottom edge zone 19. The transmission zone 20 may be formed by the transmission windows 11.

The transmission zone 20 may comprise a repetitive pattern of bridges 17 and transmission window portions 16. In an embodiment the repetitive pattern may comprise three different transmission windows 11 having different locations and/or different numbers of bridges 17, as can be seen from in FIG. 3. For example, a first transmission window 11 may comprise two bridges 17, a second transmission window 11 neighboring the first transmission window 11 may comprise three bridges 17, and a third transmission window 11 neighboring the second transmission window 11 may also comprise three bridges 17, wherein said bridges 17 may have different heights within the transmission zone 20. In other embodiments, the repetitive patterns may comprise two, four, five or more different bridge arrangements, or all transmission windows 11 may have the same bridge locations.

Spaces 21 may be provided between the transmission windows 11. The spaces 21 may form transmission window frames. A function of the bridges 17 may be to reinforce these transmission window frames, to prevent deformation of the transmission window frame. The bridges 17 may affect signal reception by the detector 9 because they may block a signal. Hence, the transmission windows 11 and its bridges pattern may be determined according to a balance between signal reception and a relatively robust print head carriage feedback system.

In an embodiment, the reference strip 10 may have a length L of approximately 1 meter or more. In further embodiments the length of the reference strip 10 is approximately 1.9 meters or more, or approximately 2.4 meters or more, for example corresponding to the scan length of the respective print system 1. The reference strip 10 may have a thickness T (see FIG. 2) of between approximately 0.01 and approximately 1 millimeter, for example around approximately 0.05 millimeter. The reference strip 10 may comprise metal.

The reference strip 10 may have a height H of between approximately 2 and approximately 50 millimeters, or for example between approximately 5 and approximately 30 millimeters. In an embodiment, the height H of the reference strip 10 is approximately 13.5 millimeters. The transmission zone 20 may be between approximately 1 and approximately 20 millimeters, for example approximately 6 millimeter.

In an embodiment, the transmission windows 11 may have a width W of between approximately 0.01 and approximately 0.4 millimeters, for example between approximately 0.03 and approximately 0.2 millimeters. In an embodiment the width W of the transmission windows 11 is approximately 0.0847 millimeters. In an embodiment, a Space S between neighboring transmission windows 11 may be between approximately 0.04 and approximately 0.4 millimeter, for example between approximately 0.03 and approximately 0.2 millimeters. In an embodiment the said space S is approximately 0.0847 millimeters. The space S between subsequent transmission windows 11 may be approximately the same as the width W of the transmission windows 11. The pitch of the transmission windows 11 may be approximately 0.17 millimeters.

The bridges 17 may have a width B of between approximately 0.01 and approximately 0.5 millimeters, the width B being determined by the distance between two transmission window portions 16 of the same transmission window 11, as can be seen from FIG. 4. The width B of the bridge may be between approximately 0.01 and approximately 0.25 millimeters, for example approximately 0.135 millimeters, or at least approximately 0.05 millimeters.

In the shown embodiments, the transmission windows 11 may comprise through holes in the reference strip 10, which may prevent that aerosol sticks to the transmission windows 11 and facilitates better transmission. The dimensions of the transmission windows 11 may prevent that aerosol passes through the transmission windows 11, onto the receivers 15. In another embodiment (not shown), the reference strip 10 may comprise a transparent film or layer covering the transmission windows 11.

Figure 5:
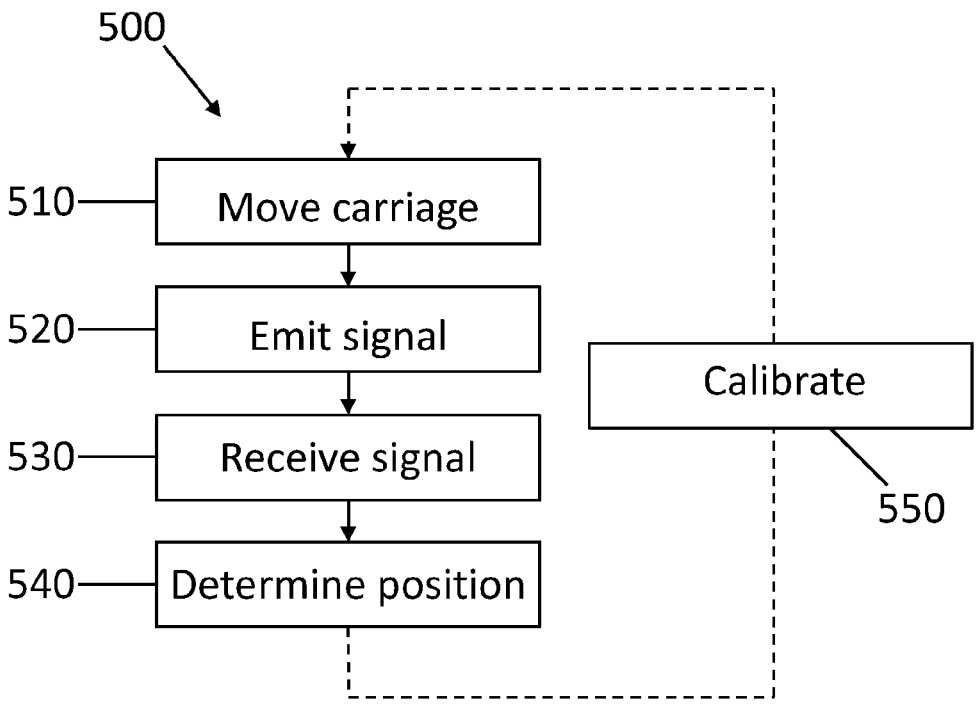
FIG. 5 shows a flow chart of an embodiment of a method of determining a position of a print head carriage.

FIG. 5 shows an embodiment of a method 500 of determining a position of a print head carriage 3. In a step 510, the print head carriage 3 may be moved along the reference strip 10. In an embodiment, the reference strip 10 may extend through the print head carriage 3. In a further step 520, a signal may be emitted by the emitter 14, onto the reference strip 10. The signal may comprise an optical signal. The signal may be transmitted by the transmission windows 11. The signal may be received by the receivers 15, in a further step 530. The signal may be interrupted by the spaces 21 between the transmission windows 11 and by the bridges 17. The signal interruption caused by the spaces 21 between the transmission windows 11 may be received by the receivers 15 and processed by the processor 13 for determination of a position of the print head carriage 3. The signal interruptions caused by the bridges 17 may be such that they have a reduced effect on the signal received by the respective receivers 15, or may be such that the position of the print head carriage 3 can still be derived with sufficient accuracy. The position of the print head carriage 3 with respect to the scan axis 6 may be determined, in a further step 540, for example by deriving from the total interrupted signal the interruptions caused by said spaces 21. If the determined position of the print head carriage 3 is determined to be different than the desired position, than the processor 13 may provide feedback to the drive system to adjust a speed and/or position of the print head carriage 3, as indicated by calibration step 550. The steps 510-550 may be performed approximately simultaneously and/or in any order. Multiple algorithms, as stored by the storage unit 12, may be suitable to derive the print head carriage position from the received signals.

Figure 6:
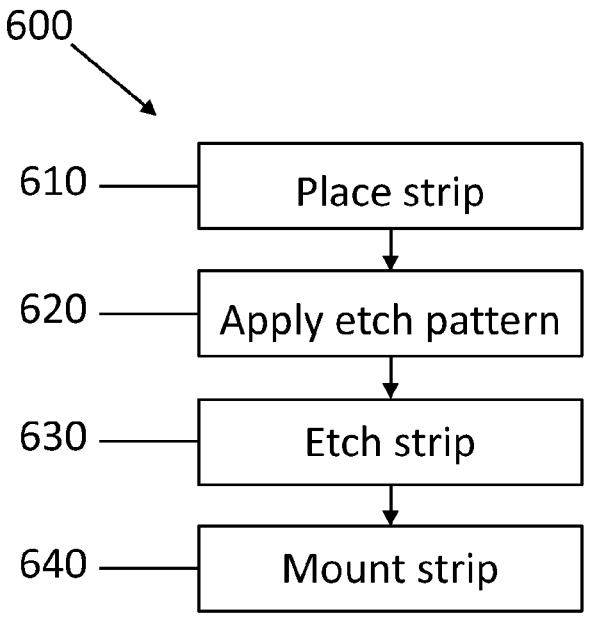
FIG. 6 shows a flow chart of an embodiment of manufacturing a reference strip.

FIG. 6 shows an embodiment of a method 600 of manufacturing a reference strip 10 for a print head carriage feedback system. In a first step 610, the method 600 may comprise placing a reference strip 10 so as to be etched by an etch process. Multiple etch process may be suitable for etching the transmission windows 11 in the reference strip 10. In a second step 620, a transmission window pattern may be applied to the reference strip 10. For example, a mask may be applied to the reference strip 10. The mask may comprise the transmission window pattern. In a third step 630, the transmission windows 11 may be etched in the reference strip 10. A negative or positive of the mask may be etched in the reference strip 10, which may for example comprise a suitable metal, for formation of the desired transmission window pattern. The transmission windows 11 may be etched so as to be arranged in parallel and/or approximately perpendicular to a longitudinal direction L of the reference strip 10. The transmission windows 11 may be etched having a width W of approximately 0.4 millimeter or less. The transmission windows may be arranged in a pattern having a pitch of approximately 0.8 millimeter or less, for example approximately 0.17 millimeters. For each transmission window 11, the etch operation may etch multiple through holes with at least one interruption in between. The interruption may form a bridge 17, as discussed above. Each through hole may be arranged to transmit a detection signal and to prevent undesirable quantities of aerosol from passing through. The through holes may form the transmission window portions 16. In a last step 640, the reference strip 10 may be mounted onto a print system 1.

The measures discussed in this disclosure may prevent aerosol from affecting the detector 9. The measures discussed in this disclosure may prevent that the reference strip 10 may be deformed during usage and/or during replacement and/or inspection of parts of the print system 1. Furthermore, the measures discussed in this disclosure may be manufactured relatively efficiently.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. The indefinite article "a" or "an" does not exclude a plurality, while a reference to a certain number of elements does not exclude the possibility of having more elements. A single unit may fulfil the functions of several items recited in the disclosure, and vice versa several items may fulfil the function of one unit.

In the following claims, the mere fact that certain measures are recited in mutually different dependent claims does not indicate that a combination of these measures cannot be used to advantage. Multiple alternatives, equivalents, variations and combinations may be made without departing from the scope of the invention.

The invention claimed is:

1. A print head carriage feedback system, comprising a reference strip arranged along a scan axis of a print head carriage, the reference strip comprising transmission windows for transmitting detector signals, the print head carriage arranged to move with respect to the reference strip, along the scan axis, and a detector arranged to detect the transmission windows for determining a position of the print head carriage with respect to the scan axis, wherein the transmission windows comprise a bridge extending across the width of the respective transmission windows between edge zones of the reference strip.

2. Print head carriage feedback system according to claim 1, wherein first bridges of first transmission windows extend at a different location with respect to second bridges of second transmission windows neighboring the first transmission windows.

3. Print head carriage feedback system according to claim 1, wherein the transmission window has a longitudinal shape, the longitudinal direction of the window extending approximately perpendicular to a print head scan direction.

4. Print head carriage feedback system according to claim 1, wherein for every transmission window at least two bridges are provided.

5. Print head carriage feedback system according to claim 1, wherein the transmission windows have a width of between approximately 0.04 and approximately 0.4 millimeter.

6. Print head carriage feedback system according to claim 1, wherein neighboring transmission windows have a space of between approximately 0.04 and approximately 0.4 millimeter between each other.

7. Print head carriage feedback system according to claim 1, wherein the bridge has a width of between approximately 0.01 and approximately 0.5 millimeters, the width being determined by the distance between two transmission window portions of the same transmission window.

8. Print head carriage feedback system according to claim 1, wherein the reference strip has a length of approximately 1 meter or more.

9. Print head carriage feedback system according to claim 1, wherein the reference strip comprises two edge zones and a transmission zone between the edge zones, the transmission zone being determined by the transmission windows.

10. Print head carriage feedback system according to claim 1, wherein the reference strip has a height of between approximately 2 and approximately 50 millimeters.

11. Print head carriage feedback system according to claim 1, wherein the transmission window has a height of between approximately 0.1 and approximately 20 millimeters.

12. Print head carriage feedback system according to claim 1, wherein the detector comprises an emitter and a receiver arranged on opposite sides of the strip.

13. Print head carriage feedback system according to claim 12, wherein the emitter and receiver are arranged on the print head carriage, the reference strip extends through the print head carriage, between said emitter and receiver, and the feedback system further comprises a storage unit storing an algorithm for determining the position of the print head carriage with respect to the scan axis, and a processor configured to process signals received from the receiver according to said algorithm.

14. Print head carriage feedback system according to claim 12, wherein the emitter comprises a light emitting diode and the receiver comprises a photodiode.

15. Print head carriage feedback system according to claim 1, wherein the detector comprises multiple receivers, each having a diameter of approximately 1 millimeter or less.

16. Print head carriage feedback system according to claim 1, wherein the reference strip comprises a metal strip.

17. A method of determining a position of a print head carriage, comprising moving a print head carriage along a reference strip, the reference strip comprising transmission windows with reinforcement bridges between edge zones of the reference strip, emitting a signal onto the reference strip, receiving the signal that is interrupted by spaces between sequential transmission windows and by said reinforcement bridges, and determining the position of the print head carriage with respect to the scan axis by deriving from the interrupted signal the interruptions caused by said spaces.

* * * * *